US007591255B2

(12) United States Patent
Lejeune

(10) Patent No.: US 7,591,255 B2
(45) Date of Patent: Sep. 22, 2009

(54) INTERNAL COMBUSTION ENGINE AND EGR HEAT EXCHANGER FOR IT

(75) Inventor: Marc Lejeune, Lyons (FR)

(73) Assignee: Renault Trucks, Saint Priest (FR)

( * ) Notice: Subject to any disclaimer, the term of this patent is extended or adjusted under 35 U.S.C. 154(b) by 0 days.

(21) Appl. No.: 12/158,699

(22) PCT Filed: Dec. 23, 2005

(86) PCT No.: PCT/EP2005/014223

§ 371 (c)(1),
(2), (4) Date: Jul. 16, 2008

(87) PCT Pub. No.: WO2007/073769

PCT Pub. Date: Jul. 5, 2007

(65) Prior Publication Data

US 2009/0090336 A1 Apr. 9, 2009

(51) Int. Cl.
*F02B 47/08* (2006.01)
*F02M 25/07* (2006.01)
*F02B 33/44* (2006.01)

(52) U.S. Cl. ..... 123/568.12; 123/568.11; 60/605.2

(58) Field of Classification Search ..... 123/568.12, 123/568.11, 562, 563; 60/605.2, 599, 604, 60/612

See application file for complete search history.

(56) References Cited

U.S. PATENT DOCUMENTS

| | | | | |
|---|---|---|---|---|
| 3,250,068 | A * | 5/1966 | Vulliamy | 60/602 |
| 5,771,868 | A * | 6/1998 | Khair | 123/568.12 |
| 5,974,802 | A * | 11/1999 | Blake | 60/605.2 |
| 6,293,102 | B1 * | 9/2001 | Stay et al. | 60/605.2 |
| 6,360,732 | B1 * | 3/2002 | Bailey et al. | 123/568.12 |
| 6,742,506 | B1 * | 6/2004 | Grandin | 123/568.12 |
| 2008/0092861 | A1 * | 4/2008 | Duffy et al. | 123/568.12 |

FOREIGN PATENT DOCUMENTS

DE 10135118 A1 2/2002

OTHER PUBLICATIONS

International Search Report for corresponding International Application PCT/EP2005/014223.

* cited by examiner

*Primary Examiner*—Stephen K Cronin
*Assistant Examiner*—Sizo B Vilakazi
(74) *Attorney, Agent, or Firm*—WRB - IP LLP

(57) ABSTRACT

Internal combustion engine wherein a cooling medium inlet of an EGR (Exhaust Gas Recirculation) heat exchanger is fluidly connected to a turbocharger so as to use the exhaust gas outputted by the turbine as a coolant.

9 Claims, 3 Drawing Sheets

INTERNAL COMBUSTION ENGINE AND EGR HEAT EXCHANGER FOR IT

BACKGROUND AND SUMMARY

The present invention relates to an internal combustion engine and an EGR heat exchanger for it.

There exist internal combustion engines comprising:

an intake manifold to receive and collect gas to be burnt in an engine cylinder and an exhaust manifold to collect and output exhaust gas from the engine cylinder, a first turbocharger to compress air to allow more air to fill the engine cylinder, the turbocharger including a first turbine that transforms the exhaust gas flow into mechanical energy to actuate an air-compressor, the turbine having a turbine inlet fluidly connected to the exhaust manifold to receive exhaust gas that operates the turbine and a turbine outlet to output the exhaust gas used to operate the first turbine, and an EGR (Exhaust Gas Recirculation) device to recirculate exhaust gas, the EGR device comprising an EGR heat exchanger having:

an exchanger inlet fluidly connected to the exhaust manifold through an EGR valve to receive warm EGR gas, an exchanger outlet fluidly connected to the intake manifold to output cooled EGR gas, a cooling medium inlet to receive a coolant, and a cooling medium outlet to output the coolant once it has been used to cool the EGR gas.

The existing internal combustion engines may also have a second turbocharger fluidly connected with the first turbocharger to further compress air. Turbochargers are pressure charging devices that further improves engine efficiency by using energy in an exhaust gas to provide pressure charging. Pressure charging an internal combustion engine both increases power and increases efficiency. Pressure charging is a process in which ambient air is compressed to allow more air to fill an engine cylinder. High pressure, high temperature exhaust gas enter a turbine connected to a compressor. As the high pressure, high temperature exhaust gas expands through the turbine, the turbine operates the compressor. As shown in U.S. Pat. No. 3,250,068 issued to Vulliamy on May 10, 1966 shows using turbochargers arranged in a serial fashion. This arrangement allows the turbochargers to be more responsive over a larger operative range and to further increase air pressure in the inlet manifold.

To reduce emissions, the exhaust gas recirculation (EGR) device is used for controlling the generation of undesirable pollutant gases in the operation of internal combustion engines. Such systems have proven particularly useful in internal combustion engines. EGR systems primarily recirculate exhaust gas from combustion into the intake air supply of the internal combustion engine. Exhaust gas introduced to the engine cylinder displaces a volume available for fresh air. Reduced oxygen concentrations lower maximum combustion temperatures within the cylinder and slow chemical reactions of the combustion process, decreasing the formation of nitrogen oxides (NOx), for example. Furthermore, the exhaust gases typically contain unburned hydrocarbons which are burned on reintroduction into the engine cylinder. Burning the unburned hydrocarbons further reduces the emission of undesirable pollutants from the internal combustion engine.

Cooling recirculated exhaust gas further enhances emissions reductions available through recirculating exhaust gas. Cooling the exhaust gas prior to introduction into the engine cylinder further reduces the combustion temperatures in the engine cylinder. As with lower oxygen concentrations, the reduced temperature of recirculated exhaust gas ultimately lowers production of NOx in the engine cylinder, for example.

For instance, such an engine is known from U.S. Pat. No. 6,360,732 in the name of Bailey et al.

Many of the internal combustion engine vehicles have also exhaust gas after-treatment device to clean exhaust gas before releasing it into the atmosphere. Well-known after-treatment devices are continuously re-generated diesel particulate filter or SCR (Selective Catalyse Reduction) mufflers. These after-treatment devices work correctly if the temperature of the exhaust gas to be treated is above a given threshold (300° C. for instance). For example, after starting the engine or when the vehicle speed is very low, the temperature of the exhaust gas that flows through the after-treatment device is much lower than 300° C. In those conditions, the exhaust gas cleaning is not as good as when the exhaust gas temperature is above 300° C.

It is desirable to provide an internal combustion engine that releases exhaust gas with a higher temperature than usual to improve exhaust gas cleaning, for example.

The invention provides, according to an aspect thereof, an internal combustion engine wherein the cooling medium inlet is fluidly connected to the turbine outlet so as to use the exhaust gas outputted by the turbine as the coolant.

In the above engine, the exhaust gas that flows to the after-treatment device is warmer than if exhaust gas was not used as a coolant in the heat exchanger.

Therefore, this helps the exhaust gas after treatment device to work by increasing the exhaust gas temperature. This also decreases the temperature of EGR gas so that the performance of the engine is increased.

The embodiments of the above engine may comprise one or several of the following features:

the EGR device comprises an EGR cooler which is fluidly connected to the exchanger outlet to cool the EGR gas outputted from the exchanger outlet before readmitting it into the intake manifold, the EGR cooler using a coolant which is different from exhaust gas;

the EGR cooler is also fluidly connected to an outlet of the first turbocharger to receive compressed fresh air and wherein the EGR cooler has a common internal chamber to mix together EGR gas and compressed fresh air as well as to cool EGR gas and compressed fresh air;

the engine comprises a second turbocharger to compress the air that is to be further compressed by the first turbocharger, the second turbocharger including a second turbine that transforms the exhaust gas flow into mechanical energy to actuate a second air-compressor, this second turbine having a turbine inlet to receive exhaust gas that operates the turbine and a turbine outlet to output the exhaust gas used to operate the second turbine, wherein the cooling medium outlet of the EGR heat exchanger is fluidly connected to the turbine inlet of the second turbine or wherein the cooling medium inlet of the EGR heat exchanger is fluidly connected to the turbine outlet of the second turbine to receive the exhaust gas successively expanded by the first and second turbine. The above embodiments of the engine present the following advantages:

using an EGR cooler further decreases the EGR gas temperature so that the engine performance increases and the EGR heat exchanger acts as a pre-cooler and relieves the technical constraints that are used to dimension and build the EGR cooler;

using the EGR heat exchanger to heat the exhaust gas that operates the second turbine of the second turbocharger increases the quantity of mechanical energy that the second turbine retrieves from the exhaust gas flow;

using the exhaust gas released at the outlet of the second turbine improves the efficiency of the EGR heat exchanger because exhaust gas at this outlet is colder than at the outlet of the first turbine. The invention also relates to an EGR heat exchanger suitable to be used in the above internal combustion engine.

The invention also relates to a method to operate the above internal combustion engine wherein it comprises the step of admitting exhaust gas outputted by the turbine outlet of the first turbine through the cooling medium inlet so as to use the exhaust gas outputted by the first turbine as a coolant.

These and other aspects of the invention will be apparent from the following description, and drawings.

DETAILED DESCRIPTION

Figure 1:
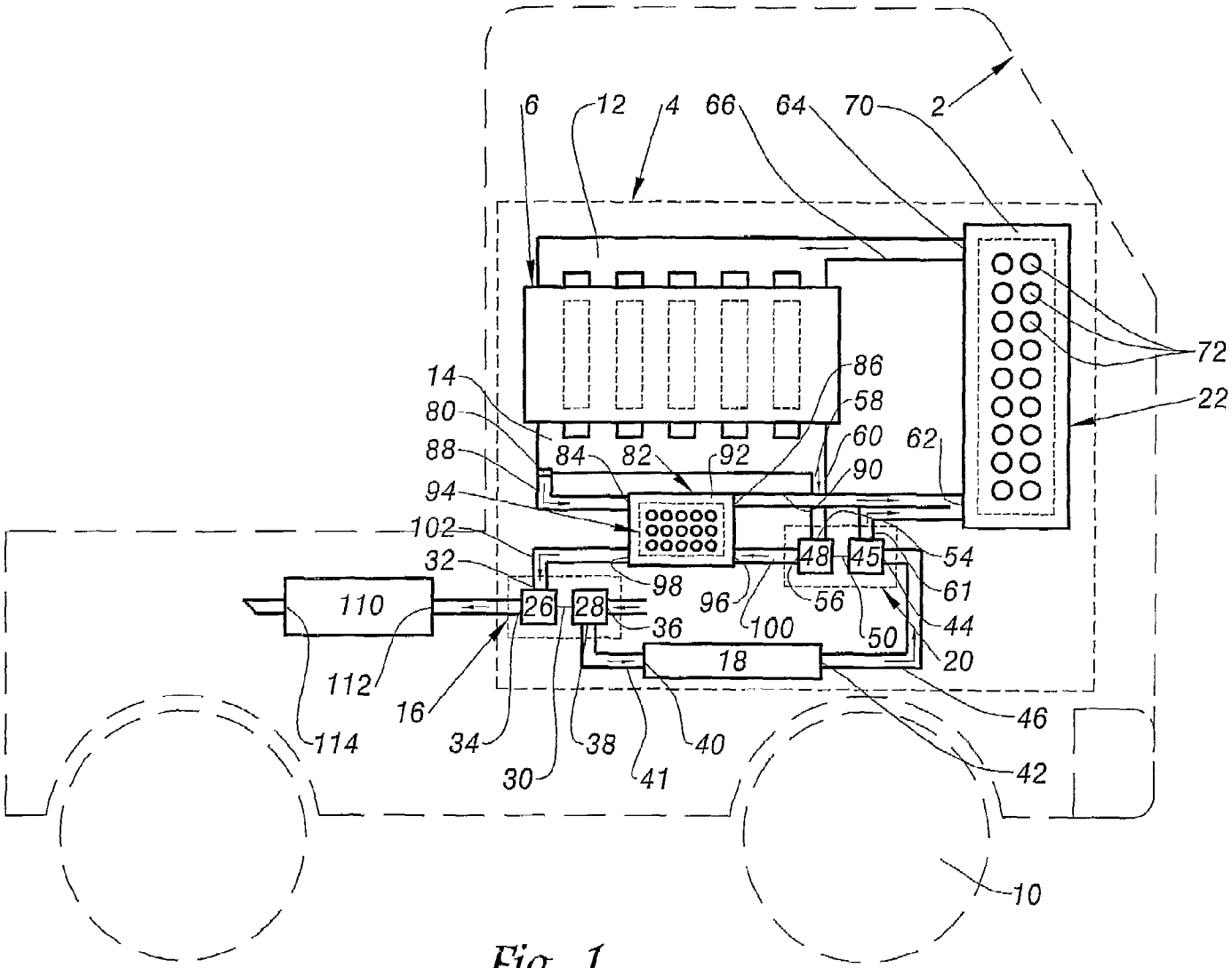
FIG. 1 is a schematic diagram of a vehicle having an internal combustion engine equipped with an EGR device.

FIG. 1 shows a vehicle 2 with an internal combustion engine 4. For example, vehicle 2 is a truck. In the following description, well-known functions or constructions by a person of ordinary skill in the art are not described in details.

For example, engine 4 is a two-stage turbo-charging engine having an EGR device. The two-stage turbo-charging engine includes:

an engine block 6 having cylinders in which diesel and air are admitted to be burnt in order to translate pistons so as to finally rotate vehicle wheels like wheel 10, an intake manifold 12 to receive and collect a mixture of fresh air and EGR gas to be burnt in the cylinders of block 6, an exhaust manifold 14 to collect exhaust gas exhausted from the cylinders of block 6, a first turbocharger 16 that compresses fresh air coming from the vehicle surrounding atmosphere, a heat exchanger 18 that cools the fresh air compressed by turbocharger 16, a second turbocharger 20 to further compress the fresh air cooled by heat exchanger 18, and a charged air cooler 22 to further cool the fresh air compressed by turbocharger 20 before admitting it into manifold 12.

In FIG. 1, dotted lines within block 6 represent cylinders.

Turbocharger 16 has a turbine 26 that actuates an air compressor 28 through a shaft 30.

Turbine 26 has a turbine inlet 32 to receive the exhaust gas that operates the turbine, and a turbine outlet 34 to output the exhaust gas used to operate the turbine.

Compressor 28 has a fresh air inlet 36 to receive captured ambient air at the atmospheric pressure, and an outlet 38 to output pressurized fresh air.

Outlet 38 is fluidly connected to an inlet 40 of heat exchanger 18 through a pipe 41 so that the pressurized fresh air flows from outlet 38 to heat exchanger 18. Heat exchanger 18 has an outlet 42 directly fluidly connected to an inlet 44 of an air compressor 45 of turbocharger 20 through a pipe 46.

Turbocharger 20 has also a turbine 48 to actuate compressor 45 through a shaft 50. Turbine 48 has an inlet 54 to receive exhaust gas used to operate this turbine and an outlet 56 to output the exhaust gas used to operate turbine 48. Inlet 54 is directly fluidly connected to an outlet 58 of manifold 14 through a pipe 60.

Compressor 45 further compresses the cooled fresh air outputted by heat exchanger 18 and outputted it through an outlet 61.

Outlet 61 is directly fluidly connected to an inlet 62 of cooler 22 so that the highly pressurized fresh air is admitted into cooler 22.

Cooler 22 has an outlet 64 directly fluidly connected to manifold 12 through a pipe 66 to output cooled charged air into manifold 12. Cooler 22 has an internal chamber 70 to collect the charged air to be outputted through outlet 64. For example, cooler 22 has also one or many tubes 72 within which flows a cooling medium like air. Tubes 72 are placed within chamber 70 in thermal contact with the charge air to be cooled.

The EGR device includes:

an EGR valve 80 to capture exhaust gas to be recirculated, an heat exchanger 82 to cool down the EGR gas, and cooler 22 to further cool down the EGR gas.

Heat exchanger 82 has an inlet 84 to receive EGR gas to be cooled and an outlet 86 to output the cooled EGR gas. Inlet 84 is directly fluidly connected to manifold 14 through a pipe 88. Valve 80 is placed within pipe 88. For example, valve 80 is placed at the entrance of pipe 88.

Valve 80 is an electronically controllable valve so that the amount of exhaust gas to be recirculated can be accurately determined.

Outlet 86 is directly fluidly connected to inlet 62 through a pipe 90. Heat exchanger 82 has an internal chamber 92 to collect the EGR gas to be cooled and tubes or plates within which a coolant flows. In FIG. 1, for example, the coolant flows within tubes 94 placed within chamber 92 so as to be in thermal contact with the EGR gas to be cooled.

Heat exchanger 82 has a cooling medium inlet 96 to receive the coolant used to cool the EGR gas and an outlet 98 used to output the coolant once it has been used to cool the EGR gas. In this embodiment) inlet 96 is directly fluidly connected to outlet 56 through a pipe 100 so as to use the exhaust gas as a coolant.

Outlet 98 is directly fluidly connected to inlet 32 through a pipe 102. Vehicle 2 has also an exhaust gas after-treatment device 110 to clean the exhaust gas outputted by engine 4.

Device 110 has an inlet 112 to receive exhaust gas to be cleaned directly fluidly connected to outlet 34. Device 110 has also an outlet 114 to output the cleaned exhaust gas into the atmosphere.

Arrows in the pipe of FIG. 1 show the flow directions of the different gases.

Figure 2:
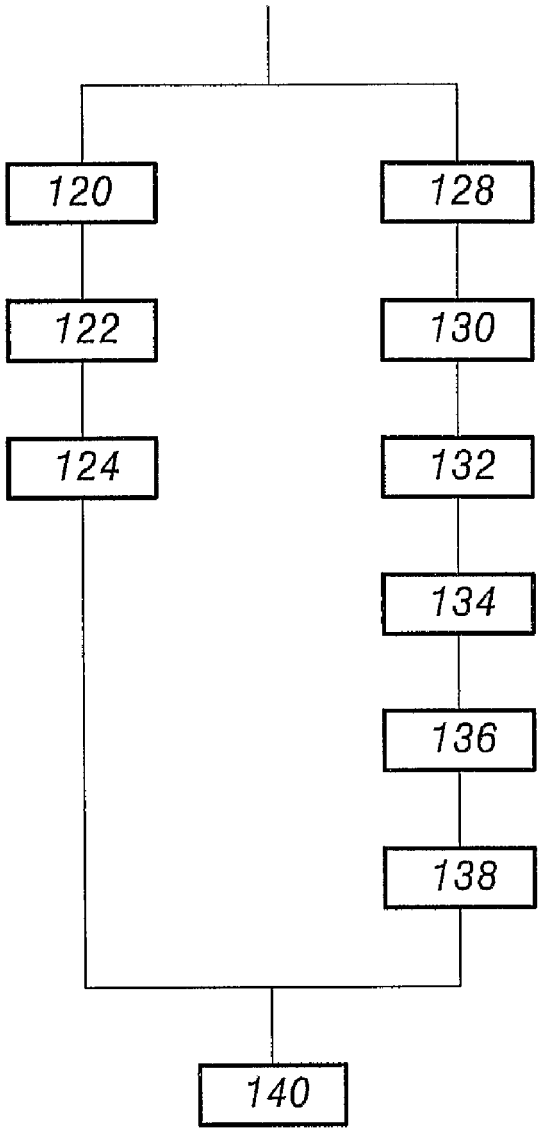
FIG. 2 is a flowchart of a method to operate the engine of the vehicle of FIG. 1.

The operation of engine 4 will now be described with reference to FIG. 2.

Initially, in step 120, valve 80 is controlled so as to admit exhaust gas within pipe 88. The admitted exhaust gas becomes the EGR gas.

Then, in step 122, EGR gas is cooled within heat exchanger 82.

Thereafter, in step 124, the cooled EGR gas is admitted into cooler 22 through pipe 90.

In parallel, in step 128, exhaust gas flows to turbine 48. In step 130, the exhaust gas flow that is admitted through inlet 54 is transformed by turbine 48 into mechanical energy that actuates compressor 45. Thus, turbine 48 acts as an expansion engine or a release valve and the exhaust gas pressure drops at the outlet 56. This also means that the exhaust gas temperature is much lower at outlet 56 than the exhaust gas temperature at inlet 54. For example, the exhaust gas temperature drop through turbine 48 is equal to about 13O<0>C.

In step 132, the exhaust gas flow, cooled by turbine 48, is admitted into heat exchanger 82 through the cooling medium inlet 96. Subsequently, in step 134, the exhaust gas that flows through tubes 94 is used as a coolant to cool the EGR gas. At the same time, the exhaust gas is heated. In step 136, the exhaust gas, heated in heat exchanger 82, flows into turbine 26 through inlet 32. In step 138, turbine 26 transforms the heated exhaust gas flow into mechanical energy to actuate compressor 28. Because the exhaust gas flow admitted into turbine 26 is warmer than if heat exchanger 82 was not used, the amount of mechanical energy that can be retrieved from this flow is higher than if heat exchanger 82 was not used.

Finally, the exhaust gas flow used to operate turbine 26 is outputted to after-treatment device 110.

In step 140, device 110 cleans the exhaust gas before releasing it within the atmosphere. The exhaust gas admitted into device 110 is warmer than if heat exchanger 82 was omitted. Thus, device 110 works better and the exhaust gas released in the atmosphere is cleaner after engine starting or for a very low vehicle speed, for example.

Figure 3:
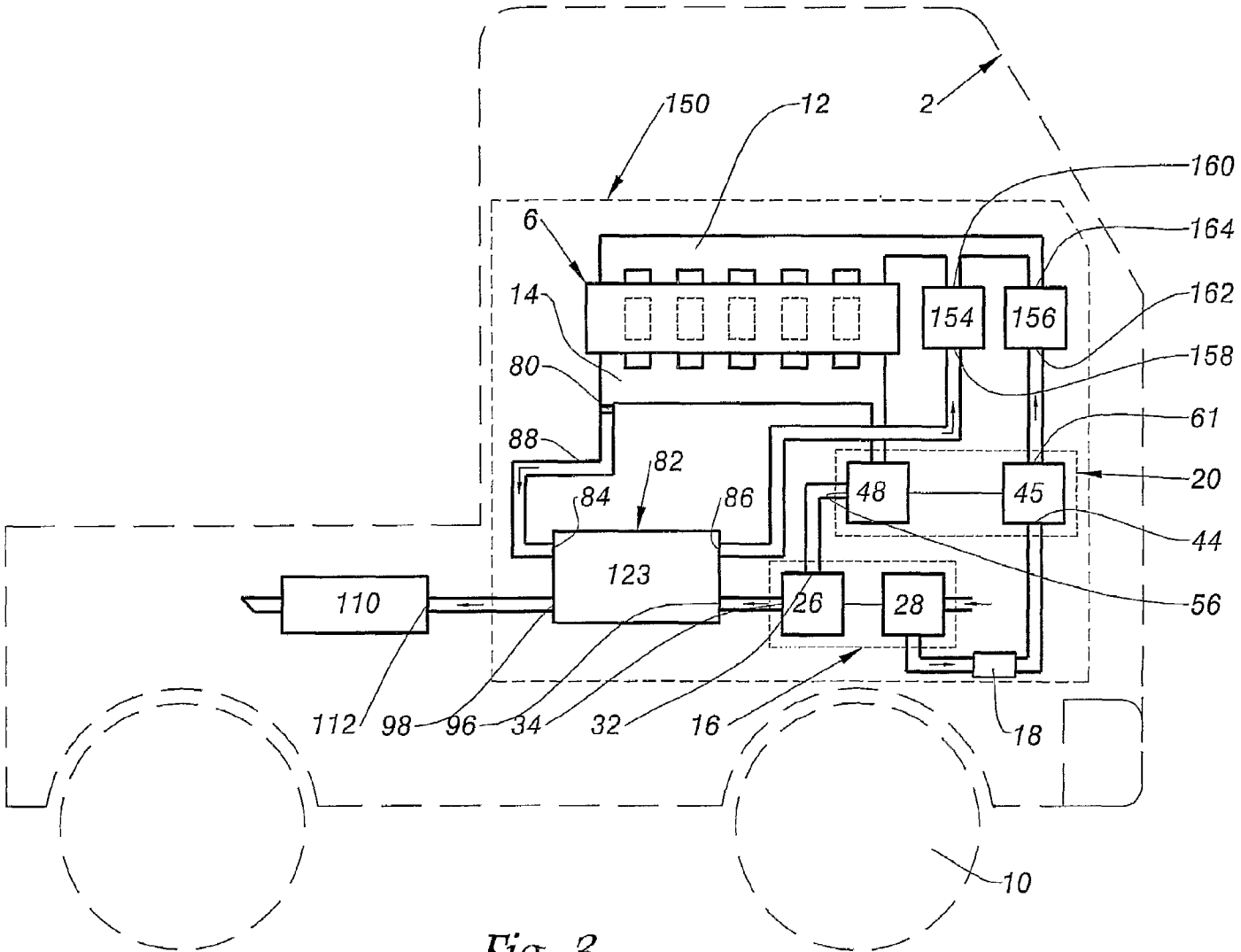
FIG. 3 is another embodiment of the internal combustion engine of the vehicle of FIG. 1.

FIG. 3 shows another embodiment of an internal combustion engine 150 suitable to be used within vehicle 2.

The features of engine 150 which are identical to features of engine 4 have the same numeral references.

Engine 150 differs from engine 4 by the two following features:

heat exchanger 82 is placed at the outlet of turbine 26, and cooler 22 is replaced by two independent coolers 154 and 156.

In FIG. 3, cooling medium inlet 96 is directly fluidly connected to outlet 34 of turbine 26 and outlet 98 is directly fluidly connected to inlet 112 of device 110. At the outlet of turbine 26, the exhaust gas temperature is lower than at outlet 56 because the exhaust gas has further been expanded by turbine 26. As a result, the efficiency of heat exchanger 82 is increased and the EGR gas outputted through outlet 86 is colder than in the embodiment of FIG. 1.

In FIG. 3, cooler 22 of FIG. 1 is replaced by EGR gas cooler 154 and an independent air cooler 156.

Coolers 154 and 156 use a different cooling medium from the one used in heat exchanger 82. For example, the cooling medium is water or fresh air.

Cooler 154 has an inlet 158 directly fluidly connected to outlet 86 to receive the EGR gas to be further cooled, and an outlet 160 to output the further cooled EGR gas into manifold 12.

Cooler 156 has an inlet 162 directly fluidly connected to outlet 61 of compressor 45. Cooler 156 has also an outlet 164 directly fluidly connected to manifold 12. In this embodiment, cooler 154 is only used to cool EGR gas and cooler 156 is only used to cool compressed fresh air.

The operation of engine 150 can be deduced from the operation of engine 4.

Many other embodiments are possible. For example, in the embodiment of FIG. 1, cooler 22 can be replaced by independent coolers 154 and 156 like this is described in view of FIG. 3.

In FIG. 1, for a low cost embodiment, turbocharger 16 can be omitted. Thus, outlet 98 is directly fluidly connected to inlet 112. The internal combustion engine can be used within any kind of vehicle like cars or boats but also outside any vehicle like for example in a diesel-electric generating set.

Valve 80 can be placed elsewhere to captured exhaust gas. For example, valve 80 can be placed after outlet 86 or after outlet 160 in FIG. 3.

In a low cost embodiment, cooler 154 of the embodiment of FIG. 3 can be omitted.

The cooling medium used in heat exchanger 18, cooler 22, coolers 154 and 156 can be of any type like, for example, water or fresh air. Tubes 94 can be replaced by plates or other suitable shapes.

LIST OF REFERENCES

2 vehicle
4 engine
6 engine block
10 wheel
12 intake manifold
14 exhaust manifold
16, 20 turbochargers
18, 82 heat exchangers
38, 42, 61, 64, 164 air outlets
36, 40, 44, 62, 162 air inlets
22, 154, 156 coolers
26, 45 turbines
32, 54, 112, 158 exhaust gas inlet
34, 56, 114, 160 exhaust gas outlet
28, 45 air compressors
30, 50 shafts
41, 46, 60, 88, 90, 100, 102 pipes
70, 92 internal chambers
72, 94 tubes
80 EGR valve
96 cooling medium inlet cooling medium outlet o after-treatment device 0 internal combustion engine

The invention claimed is:

1. Internal combustion engine comprising:

an intake manifold to receive and collect gas to be burnt in an engine cylinder and an exhaust manifold to collect and output exhaust gas from the engine cylinder, a first turbocharger to compress air to allow more air to fill the engine cylinder, the turbocharger including a first turbine that transforms exhaust gas flow into mechanical energy to actuate an air-compressor, the first turbine having a turbine inlet fluidly connected to the exhaust manifold to receive exhaust gas that operates the first turbine and a turbine outlet to output the exhaust gas used to operate the first turbine, and an EGR (Exhaust Gas Recirculation) device to recirculate exhaust gas, the EGR device comprising an EGR heat exchanger having:

an exchanger inlet fluidly connected to the exhaust manifold through an EGR valve to receive warm EGR gas, an exchanger outlet fluidly connected to the intake manifold to output cooled EGR gas, a cooling medium inlet to receive a coolant, and a cooling medium outlet to output the coolant once it has been used to cool the EGR gas wherein the cooling medium inlet is fluidly connected to the turbine outlet so as to use the exhaust gas outputted by the turbine as the coolant.

2. The engine according to claim 1, wherein the EGR device comprises an EGR cooler which is fluidly connected to the exchanger outlet to cool the EGR gas outputted from the exchanger outlet before readmitting it into the intake manifold, the EGR cooler using a coolant which is different from exhaust gas.

3. The engine according to claim 2, wherein the EGR cooler is fluidly connected to an outlet of the first turbocharger to receive compressed fresh air and wherein the EGR cooler has a common internal chamber to mix together EGR gas and compressed fresh air as well as to cool EGR gas and compressed fresh air.

4. The engine according to claim 1, wherein the engine comprises a second turbocharger to compress the air that is to be further compressed by the first turbocharger, the second turbocharger including a second turbine that transforms the exhaust gas flow into mechanical energy to actuate a second air-compressor, this second turbine having a turbine inlet to receive exhaust gas that operates the second turbine and a turbine outlet to output the exhaust gas used to operate the second turbine, wherein the cooling medium outlet of the EGR heat exchanger is fluidly connected to the turbine inlet of the second turbine.

5. The engine according to claim 1, wherein the engine comprises a second turbocharger to compress the air that is to be further compressed by the first turbocharger, the second turbocharger including a second turbine that transforms the exhaust gas flow into mechanical energy to actuate a second air-compressor, the second turbine having a turbine inlet fluidly connected to the first turbine outlet to receive exhaust gas that operates the second turbine and a turbine outlet to output the exhaust gas used to operate the second turbine, and wherein the cooling medium inlet of the EGR heat exchanger is fluidly connected to the turbine outlet of the second turbine to receive the exhaust gas successively expanded by the first and second turbine.

6. An EGR heat exchanger suitable to be used in an internal combustion engine according to claim 1, wherein the EGR heat exchanger has:

an exchanger inlet suitable to be fluidly connected to the exhaust manifold to receive the warm EGR gas, an exchanger outlet suitable to be fluidly connected to the intake manifold to output cooled EGR gas, a cooling medium inlet to receive a coolant, and a cooling medium outlet to output the coolant once it has been used to cool the EGR gas, wherein the cooling medium inlet is designed to be fluidly connected to the turbine outlet so as to use the exhaust gas outputted by the turbine as the coolant.

7. An EGR heat exchanger suitable to be used in an internal combustion engine according to claim 4, wherein the cooling medium outlet is suitable to be fluidly connected to the turbine inlet of the second turbine.

8. An EGR heat exchanger suitable to be used in an internal combustion engine according to claim 5, wherein the cooling medium inlet of the EGR heat exchanger is suitable to be fluidly connected to the turbine outlet of the second turbine to receive the exhaust gas successively expanded from the first and second turbine.

9. A method to operate an internal combustion engine, the internal combustion engine comprising:

an intake manifold to receive and collect gas to be burnt in an engine cylinder and an exhaust manifold to collect and output exhaust gas from the engine cylinder, a first turbocharger to compress air to allow more air to fill the engine cylinder, the turbocharger including a first turbine that transforms the exhaust gas flow into mechanical energy to actuate an air-compressor, the first turbine having a turbine inlet fluidly connected to the exhaust manifold to receive exhaust gas that operates the first turbine and a turbine outlet to output the exhaust gas used to operate the first turbine, and an EGR (Exhaust Gas Recirculation) device to recirculate exhaust gas, the EGR device comprising an EGR heat exchanger having:

an exchanger inlet fluidly connected to the exhaust manifold through an EGR valve to receive warm EGR gas, an exchanger outlet fluidly connected to the intake manifold to output cooled EGR gas, a cooling medium inlet to receive a coolant, and a cooling medium outlet to output the coolant once it has been used to cool the EGR gas wherein the cooling medium inlet is fluidly connected to the turbine outlet so as to use the exhaust gas outputted by the turbine as the coolant, wherein the method comprises admitting exhaust gas outputted by the turbine outlet of the first turbine through the cooling medium inlet so as to use the exhaust gas outputted by the first turbine as a coolant.

* * * * *